US006603255B2

(12) United States Patent
Takahashi

(10) Patent No.: US 6,603,255 B2
(45) **Date of Patent: *Aug. 5, 2003**

(54) IMAGE DISPLAY UNIT

(75) Inventor: Nobuyuki Takahashi, Hiratsuka (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/506,698

(22) Filed: Feb. 18, 2000

(65) Prior Publication Data

US 2003/0085651 A1 May 8, 2003

(30) Foreign Application Priority Data

Feb. 23, 1999 (JP) ..... 11-045371

(51) Int. Cl.[7] ..... H01J 63/04

(52) U.S. Cl. ..... 313/496; 313/495; 313/493; 313/497

(58) Field of Search ..... 313/493, 495, 313/496, 625; 445/25

(56) References Cited

U.S. PATENT DOCUMENTS

| | | | | | |
|---|---|---|---|---|---|
| 4,727,284 | A | * | 2/1988 | Ohkoshi et al. | 313/497 |
| 5,357,165 | A | | 10/1994 | Shibaoka et al. | 313/477 R |
| 5,578,903 | A | * | 11/1996 | Pepi | 313/583 |
| 5,786,660 | A | * | 7/1998 | Clerc | 313/495 |
| 5,831,387 | A | * | 11/1998 | Kaneko et al. | 313/495 |
| 6,006,003 | A | * | 12/1999 | Kim | 385/147 |
| 6,077,142 | A | * | 6/2000 | Stansbury | 445/25 |
| 6,114,804 | A | * | 9/2000 | Kawase et al. | 313/495 |
| 6,252,349 | B1 | * | 6/2001 | Inoue et al. | 313/497 |

FOREIGN PATENT DOCUMENTS

| | | |
|---|---|---|
| EP | 0 942 449 | 9/1999 |
| JP | 4-94038 | 3/1992 |
| JP | 4-163833 | 6/1992 |
| JP | 5-114372 | 5/1993 |
| JP | 7-235255 | 9/1995 |

* cited by examiner

*Primary Examiner*—Sandra O'Shea
*Assistant Examiner*—Anabel Ton
(74) *Attorney, Agent, or Firm*—Fitzpatrick, Cella, Harper & Scinto

(57) ABSTRACT

An image display unit includes first and second substrates spaced from each other, an electron source arranged on the first substrate, and an image display member arranged on the second substrate and having a first electric conductor. A second electric conductor is in contact with the first electric conductor through an opening formed in the first substrate. The second electric conductor has a holding member with a portion in contact with the first substrate and a portion joined to the first substrate through an adhesive. The holding member may also have a portion coming in contact with an outer surface of the first substrate and a portion joined to the outer surface of the first substrate through the adhesive.

5 Claims, 10 Drawing Sheets

IMAGE DISPLAY UNIT

BACKGROUND OF THE INVENTION

1. Field of the Invention

The present invention relates to an image display unit for forming an image, and particularly relates to an image display unit having a voltage introducing terminal for applying a voltage to an anode electrode.

2. Related Background Art

In a conventional image display unit for displaying a dynamic image, etc., a CRT excellent in color reproducibility, responsive speed of an image, price, etc. has been widely used particularly as a color image display unit.

In contrast to this, the CRT has a defect in that the CRT is deep in depth with respect to a display area. Therefore, there is also conventionally a request for the image display unit of a planar type. In recent years, the image display unit of a planar type using a liquid crystal has spread instead of the CRT, but is not of a self light emission type. Therefore, problems exist in that the planar type image display unit must have a back light and field of view depends on angle, etc. Accordingly, the development of a display unit of the planar type and the self light emission type has been desired.

A color plasma display begins to be recently commercialized as such a planar type image display unit of self light emission. However, the principle of light emission in the color plasma display differs from that in the conventional CRT. Therefore, in the present situation, the color plasma display is slightly inferior to the CRT with respect to the contrast of an image, goodness of coloring, etc.

However, in the case of an image display unit using an electron beam similar to the CRT, it can be expected that an image quality equivalent to that in the CRT is obtained. Therefore, the planar type image display unit using the electron beam is researched and developed in many cases.

In these many planar type image display units using the electron beam, plural electron emitting devices of hot cathode and cold cathode types are arranged as a generating source of electrons (hereinafter, simply called an electron source) so that a deflecting space of the electron beam required in the CRT is reduced and the display unit is made thin and flat.

With respect to image display, these planar type image display units use the same principle as the CRT in which an electron emitted from the above electron source is accelerated by a high voltage and is irradiated to a phosphor. Accordingly, it is expected that an image quality similar to that in the CRT is obtained.

For example, Japanese Patent Application Laid-Open No. 4-163833 discloses a planar type image display unit using an electron beam and including a linear hot cathode and a complicated electrode constructional body within a vacuum container.

In these planar type image display units using the electron beam, for example, there is a case in which one portion of the electron beam incident to the phosphor is scattered and collides with an inner wall of the vacuum container, and a secondary electron is emitted and a charge is increased in this emitting portion. In this case, an internal electric potential distribution is distorted and an orbit of the electron beam becomes unstable. Further, an electric discharge is caused within the display unit so that there is a fear that the display unit is deteriorated and broken.

There is a method for forming a charging preventing film in the inner wall of the vacuum container as a method for preventing such an increase in charge. For example, Japanese Patent Application Laid-Open No. 4-163833 discloses a construction in which a conductive layer constructed by a conductive material of high impedance is arranged on a side face of the inner wall of a glass container of the image display unit.

In the image display unit using the electron beam, a high voltage for accelerating electrons is applied between the electron source and the phosphor.

Therefore, when the vacuum container of the image display unit is constructed by glass including Na such as a blue plate glass, etc., Na ions are moved by the above electric field and an electrolytic current is caused.

The vacuum container using glass is formed by joining plural members by frit glass. However, when Na ions flow into the frit glass by the above electrolytic current, PbO included in the frit glass is reduced and Pb is deposited. Accordingly, there is a fear that a crack is caused in the frit glass and no vacuum within the container can be held.

In contrast to this, there is a method in which an electrode is arranged in a suitable position of an outer wall of the vacuum container and an electrolytic current is absorbed into this electrode so that no electrolytic current flows into the frit glass.

For example, Japanese Patent Application Laid-Open No. 4-94038 shows a construction in which a conductive film of low resistance is arranged in a peripheral portion of a face plate and is set to a ground electric potential and no electrolytic current flows into the frit glass. U.S. Pat. No. 5,357,165 discloses a construction in which a band-shaped electrode for forming the gradient of an electric potential by flowing a current is arranged in a side wall of the vacuum container.

In contrast to this, in the planar type image display unit utilizing the above electron beam described in Japanese Patent Application Laid-Open No. 4-163833, the deflecting space of the electron beam required in the conventional CRT is greatly reduced by using plural linear hot cathodes. However, the complicated electrode constructional body such as a horizontal deflecting electrode, a vertical deflecting electrode, etc. for deflecting the electron beam to plural pixels (phosphor) is included within the container. Therefore, it cannot be avoided that the display unit has a certain thickness (about several ten mm). However, in recent years, for example, the development of a display unit of a super thinner type similar to that of a liquid crystal display is also required in the planar type image display unit utilizing the electron beam as a portable information terminal device, etc.

The present applicant already made many proposals with respect to a surface conduction electron emitting device and a planar type image display unit using this surface conduction electron emitting device to achieve the planar type image display unit of a super thin type utilizing the electron beam. For example, such proposals are described in Japanese Patent Application Laid-Open No. 7-235255.

This electron emitting device is simple in construction and many electron emitting devices can be integrated and formed in a large area. Therefore, one electron emitting device can be also formed with respect to one pixel (phosphor), land it is possible to remove the deflecting space of the electron beam required in the planar type image display unit utilizing the electron beam described in the above Japanese Patent Application Laid-Open No. 4-163833, or the normal CRT. Therefore, the electron emitting device can be used in a very thin planar type image display unit.

Further, a planar type image display unit of a super thin type using a field emitter type electron emitting device (hereinafter, called an FE type device) as the electron source is described in Japanese Patent Application Laid-Open No. 5-114372.

The planar type image display unit of a super thin type capable of relatively stably introducing a high voltage is shown by an introducing structure of the high voltage in the above-mentioned conventional display unit (FIG. 11). In accordance with FIG. 11, a face plate 2 is formed oppositely to a rear plate 1, and a low voltage electrode 12 for a wiring electrode for scanning and a wiring electrode for applying a signal voltage is formed in the electron emitting device in the rear plate 1. A phosphor, each layer of a metal back and a phosphor pull-out electrode 6 are formed in the face plate 2. A bar-shaped electrode 9 and an elastic body 28 connected to the bar-shaped electrode 9 from a side of the rear plate 1 are sequentially connected to this phosphor pull-out electrode 6. The bar-shaped electrode 9 is supported by an insulator 27 adhered by a frit glass 28 of an adhesive. The high voltage is supplied from this bar-shaped electrode 9 and is applied, to the phosphor pull-out electrode 6. An electron from the electron source having the electron emitting device on a side of the rear plate 1 is attracted and light emission of the phosphor is accelerated and an image is formed.

However, in the above planar type image display unit (FIG. 11) in the conventional example, elastic force of the elastic body using a metal is weakened by heat at a seal-attaching time and there is a case in which a connection defect is caused. There is also a case in which a small leak is caused since a seal body is formed later.

Further, a joining operation is performed in an interposing state of the adhesive between a voltage introducing terminal for introducing a voltage from the exterior of the vacuum container to an electrode on an inner surface of the face plate and the rear plate having the electron source constructed by the plural electron emitting devices formed on a planar substrate. Therefore, the planar type image display unit has the following problems.

The distance between the rear plate and the voltage introducing terminal is dispersed by melting irregularities of the adhesive. Accordingly, there is a case in which a defect in contact of a pull-out wiring formed in the face plate and a central electrode of the voltage introducing terminal is caused. Therefore, there is a case in which electric conduction with the face plate becomes unstable.

Since the distance between the rear plate and the voltage introducing terminal is dispersed by the melting irregularities of the adhesive, internal stress is caused in pressurization of the adhesive and heating burning and there is a case in which a slow leak due to a defect in seal attachment is caused after the seal attachment.

SUMMARY OF THE INVENTION

An object of the present invention is to provide an image display unit having a conductive path with good electric conduction to apply a voltage from the exterior of a container to an electric conductor within the container.

Another object of the present invention is to provide an image display unit connected in good condition to an electric conductor within a container and having an electric conductor for supplying a voltage from the exterior of the container to the electric conductor within the container.

Another object of the present invention is to provide an image display unit having a container sufficiently airtightly sealed and attached.

The present invention resides in an image display unit comprising: a container constructed by a member including first and second substrates spaced from each other; an electron source arranged on the first substrate within the container; an image display member arranged on the second substrate within the container and having a first electric conductor; and a second electric conductor coming in contact with the first electric conductor through a hole formed in the first substrate, the image display unit being characterized in that the second electric conductor has a holding member to the first substrate and the holding member has a portion coming in contact with the first substrate and a portion joined to the first substrate through an adhesive.

The present invention also resides in an image display unit comprising: a container constructed by a member including first and second substrates spaced from each other; an electron source arranged on the first substrate within the container; an image display member arranged on the second substrate within the container and having a first electric conductor; and a second electric conductor coming in contact with the first electric conductor through a hole formed in the first substrate, the image display unit being characterized in that the second electric conductor has a holding member to the first substrate and the holding member has a portion coming in contact with an outer surface of the first substrate and a portion joined to the outer surface of the first substrate through an adhesive.

The above image display unit of the present invention also includes that

- the first substrate is a rear plate and the second substrate is a face plate,
- the container is constructed by the first substrate, the second substrate and a supporting frame nipped by both the substrates,
- the first electric conductor is an anode electrode,
- the first electric conductor is a metal back,
- the first electric conductor is a pull-out electrode electrically connected to the anode electrode or the metal back,
- the image display member has the anode electrode or the metal back, and a phosphor,
- the holding member is an insulator, and
- the second electric conductor and the holding member constitute a voltage introducing terminal for applying a voltage to the first electric conductor.

The present invention also resides in an image display unit comprising: a rear plate having an electron source; a face plate arranged oppositely to the rear plate such that a phosphor emitting light by irradiating an electron beam emitted from the electron source and an anode electrode for applying a voltage to the phosphor are arranged on an inner surface of the face plate; a supporting frame nipped in side edge portions of the rear plate and the face plate and constituting one portion of a container together with the rear plate and the face plate; and a voltage introducing terminal for introducing a voltage from the exterior of the container to the anode electrode on the inner surface of the face plate, the image display unit being characterized in that the voltage introducing terminal has a central electrode and an insulator covering the circumference of the central electrode, and also has a portion coming in contact with the rear plate and a portion joined to the rear plate through an adhesive in a joining portion joined to the rear plate through a hole formed in the rear plate.

The above image display units of the present invention also include that the voltage introducing terminal has the central electrode and the insulator covering the circumference of the central electrode, and also has a groove for arranging the adhesive in one portion of a portion coming in contact with the rear plate in the joining portion joined to the rear plate through the hole formed in the rear plate, and further has a portion joined to the rear plate through the adhesive, the container is formed by adhering the insulator of the voltage introducing terminal to the hole formed in the rear plate, the electron source has plural electron emitting devices, and the electron emitting devices are cold cathode electron emitting devices.

DETAILED DESCRIPTION OF THE PREFERRED EMBODIMENTS

In accordance with an image display unit of the present invention, the above holding member has a portion coming in contact with the above first substrate and a portion joined to the above first substrate through an adhesive. Accordingly, a slow leak due to melting irregularities of the adhesive can be prevented. Further, joining strength of the above holding member and the above first substrate is improved, and the first and second electric conductors can be preferably electrically connected to each other.

Further, in accordance with the image display unit of the present invention, a portion coming in contact with the rear plate and a portion junctioned to the rear plate through the adhesive is formed in the above voltage introducing terminal so that the distance between the voltage introducing terminal and the rear plate can be prescribed. Thus, sufficient connection can be obtained irrespective of melting irregularities of the adhesive so that reliability of the connection of the anode electrode formed in the face plate and the central electrode formed in the voltage introducing terminal can be improved.

Preferred embodiment modes of the present invention will next be explained in detail with reference to the drawings.

Figure 1A:
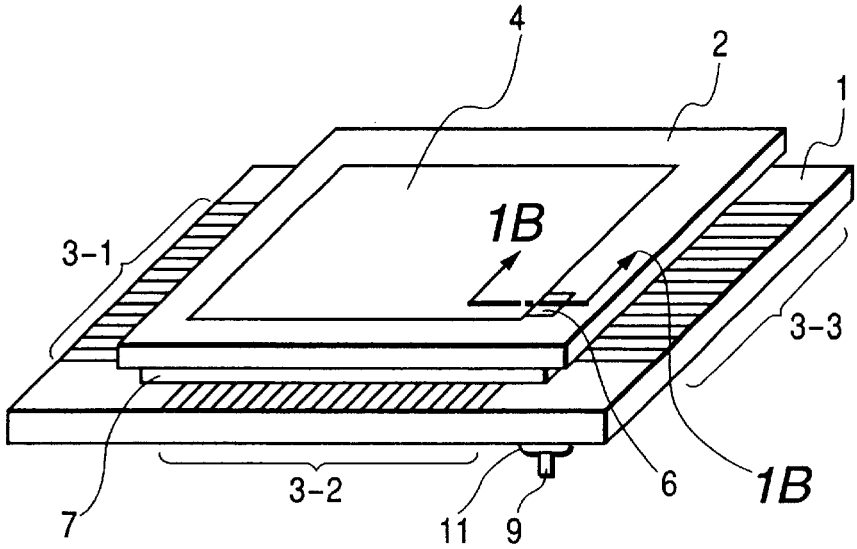
FIGS. 1A and 1B are respectively a perspective view showing the schematic entire construction of a planar type image display unit of the present invention, and a partially enlarged sectional view showing a main portion of a voltage introducing terminal portion in the present invention.
Figure 1B:
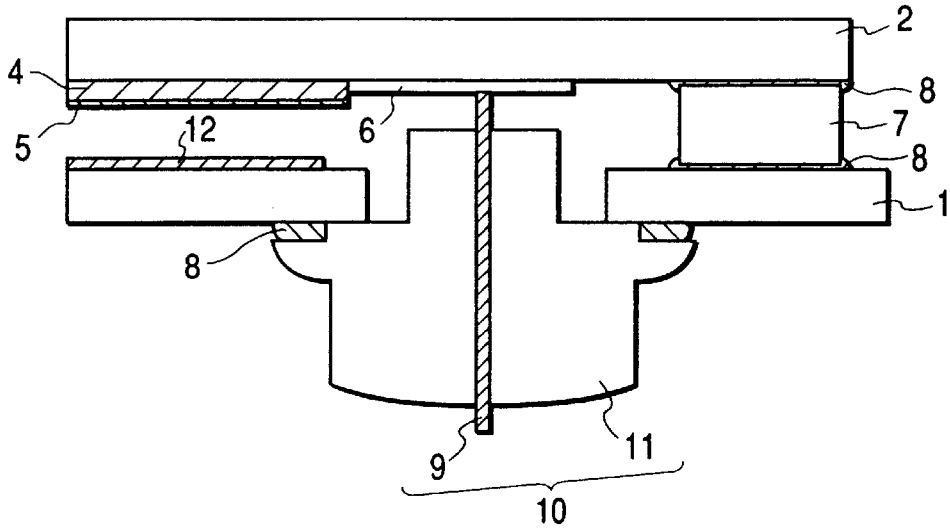

FIG. 1A is a perspective view showing the schematic entire construction of a planar type image display unit in an embodiment mode of the present invention. FIG. 1B is a partially enlarged sectional view showing a main portion of a voltage introducing terminal in this embodiment mode.

In each of these figures, reference numerals 1 and 2 respectively designate a rear plate (a first substrate) also used as a substrate for forming an electron source, and a face plate (a second substrate). A phosphor 4 and an anode electrode (not shown) as an image display member are formed on an inner surface of the face plate 2. Each of the rear plate 1 and the face plate 2 can be constructed by using various kinds of materials such as a blue plate glass, a blue plate glass forming an $SiO_2$ coating film on its surface, glass having a small content of Na, quartz glass, or ceramics, etc., in accordance with conditions. The phosphor 4 and a pull-out electrode 6 are expressed equivalently from the face plate 2 to make an explanation.

A substrate for forming the electron source may be arranged separately from the rear plate 1 and may be also joined to the rear plate 1 after the electron source is formed.

Reference numerals 3-1, 3-2 and 3-3 designate wirings for operating the electron source and these wirings are taken out to the exterior of the image display unit and are connected to a driving circuit (not shown) of the electron source. Wirings 3-1 and 3-3 show an example in which these wirings are introduced as odd and even lines for a scanning signal from both directions, or an example in which image display areas are supplied for the scanning signal every half from both the directions.

A supporting frame 7 is nipped by the rear plate 1 and the face plate 2 and is joined to the rear plate 1 and the face plate 2 by a frit glass 8 so that a vacuum container sealed in its interior is formed. The wirings 3-1, 3-2 and 3-3 of the driving circuit of the electron source are buried in the frit glass 8 in a joining portion of the supporting frame 7 and the rear plate 1 and are pulled out to the exterior. A voltage introducing terminal 10 has an insulator (a holding member) 11 and a central electrode (a second electric conductor) 9.

The above central electrode 9 is an electrode for supplying a high voltage to the above anode electrode formed in the image display member arranged on the inner surface of the face plate 2. The central electrode 9 extends through a passing hole for fitting the insulator 11 holding the central electrode 9 of the voltage introducing terminal and arranged in the rear plate 1. The central electrode 9 then comes in contact with a first electric conductor such as the anode electrode or the pull-out electrode 6, etc. connected to the anode electrode and pulled out.

A getter, etc. are further arranged within the vacuum container in accordance with necessity.

FIG. 1B is a typical view showing a sectional construction taken along the line 1B—1B of FIG. 1A. In FIG. 1B, reference numerals 2 and 5 respectively designate the face plate and an electric conductor. The electric conductor 5 is the anode electrode formed in contact with the phosphor 4 and is constructed by a metallic film (normally Al (aluminum)) called a metal back. The frit glass 8 is arranged as an adhesive. Reference numeral 12 designates an arbitrary low voltage wiring electrode such as a wiring electrode for operating the electron source, or an electrode having a connection electric potential of a charging-preventing film, etc. in the vicinity of the voltage introducing terminal 10.

In FIG. 1B, the voltage introducing terminal 10 is constructed by the central electrode 9 and the insulator 11 formed by ceramic covering the central electrode 9 and molded integrally with this central electrode 9. This insulator 11 is fitted into a hole formed in the rear plate 2 and is adhered to this hole by the frit glass 8. A tip of the central electrode 9 is electrically connected to the phosphor pull-out electrode 6 and a high voltage (anode voltage Va) is supplied to the phosphor 4 through the metal back 5.

The central electrode 9 and the phosphor pull-out electrode 6 can be electrically connected to each other by using a connecting method using an elastic contact, a connecting method using melting of a metal, etc.

A material of the insulator 11 covering the central electrode 9 can be constructed by using a material similar to the substrate glass 1. However, when the substrate glass 1 is a blue plate glass, etc., the insulator 11 can be also adhered by the frit glass 8 even when forsterite porcelain and steatite porcelain are used, since coefficients of thermal expansion of the insulator 11 and the substrate glass 1 are close to each other. Further, it is suitable since a higher insulating property is obtained.

With respect to a shape of the insulator 11, a step difference portion or a groove is formed in a portion directly coming in contact with the rear plate 1. A position relation of the rear plate 1 and the insulator 11 is prescribed by the step difference portion or the groove by using the portion directly coming in contact with the rear plate 1 and a portion coming in contact with the rear plate 1 through the frit glass 8. Therefore, relative positions of both the members can be prescribed irrespective of breakage of the frit glass 8.

At this time, a thickness of the step difference portion or a depth of the groove preferably ranges from 0.5 mm to 1.0 mm.

No kind of the electron emitting device constituting the electron source used in the present invention is particularly limited if electron device characteristics and properties such as a size of the electron emitting device, etc. are suitable for the image display unit as an object. It is possible to use a thermoelectron emitting element, or a field emitter element, a semiconductor electron emitting device, a MIM type electron emitting device, a cold cathode element such as a surface conduction electron emitting device, etc.

The surface conduction electron emitting device shown in an embodiment described later is preferably used in the present invention, and will next be explained briefly.

Figure 2A:
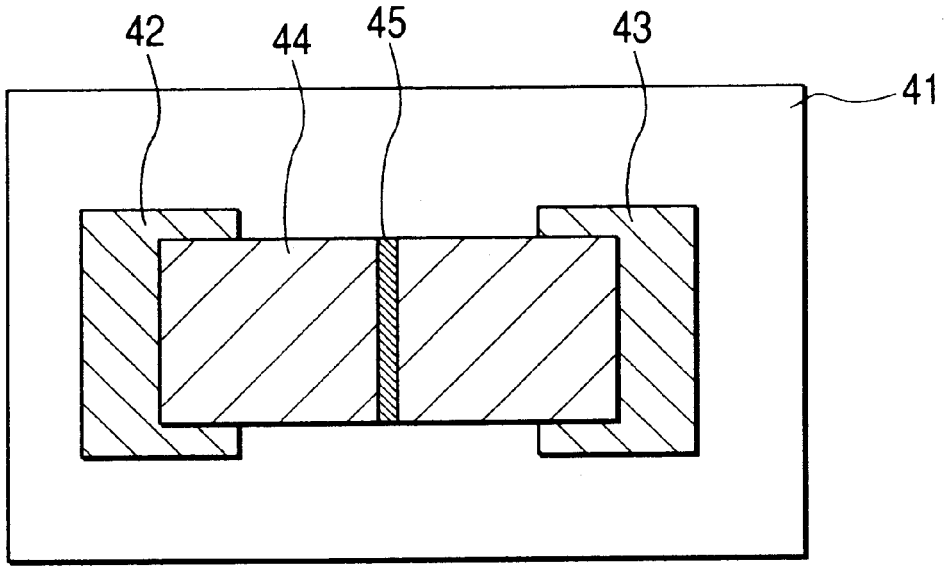
FIGS. 2A and 2B are views for explaining the construction of a surface conduction electron emitting device.
Figure 2B:
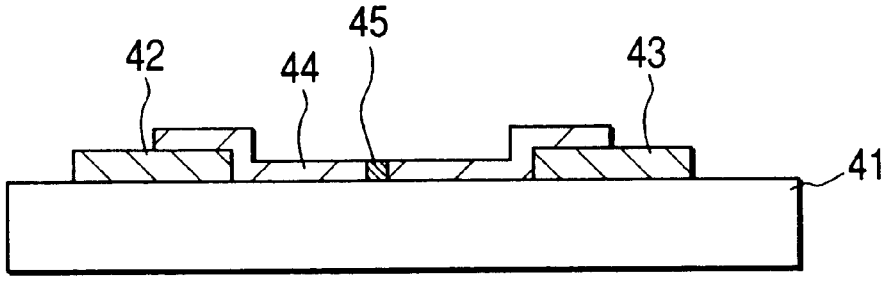

FIGS. 2A and 2B are typical views showing one example of the construction of the surface conduction electron emitting device as a unit body used in an image forming apparatus. FIGS. 2A and 2B are respectively plan and cross-sectional views of the surface conduction electron emitting device.

In FIGS. 2A and 2B, reference numeral 41 designates a basic body for forming the electron emitting device. Reference numerals 42, 43 designate a pair of device electrodes. A conductive film 44 is connected to these element electrodes. An electron emitting portion 45 is formed in one portion of this conductive film 44. The electron emitting portion 45 is a high resistance portion formed by current flowing forming processing such that one portion of the conductive film 44 is broken, deformed and deteriorated. A crack is formed in one portion of the conductive film 44 and an electron is emitted from a portion near the crack. After this current flowing forming processing, an activating treatment process is performed to improve the electron emitting characteristics of the electron emitting portion 45.

The above activating treatment process is performed by applying a voltage between the above pair of element electrodes. In this process, a pulse voltage is repeatedly applied to the above element in an atmosphere in which an organic substance exists. Thus, a substance having carbon or a carbon compound as a main component is deposited in a peripheral portion of the above electron emitting portion 45. Both a current (element current If) flowing between the element electrodes and a current (emission current Ie) caused by emitting electrons are increased by this treatment.

It is preferable to subsequently perform a stabilizing process of the electron emitting device obtained via such a process. This process is a process for exhausting the organic substance within the vacuum container. A vacuum exhausting device for exhausting the vacuum container preferably uses no oil such that no oil generated from the vacuum exhausting device has an influence on device characteristics. Concretely, the vacuum exhausting device can be constructed by a sorption pump, an ion pump, etc.

A partial pressure of the organic substance within the vacuum container is a partial pressure set such that the above carbon and carbon compound are not approximately newly deposited. The partial pressure is preferably set to be equal to or smaller than $1.3\times10^{-6}$ Pa, and is particularly preferably equal to or smaller than $1.3\times10^{-8}$ Pa. When the interior of the vacuum container is further exhausted, it is preferable to heat the entire vacuum container so as to easily exhaust molecules of the organic substance adsorbed to an inner wall of the vacuum container and the electron emitting device. In a heating condition at this time, it is desirable to heat the vacuum container for a long time as much as possible at a temperature ranging from 80 to 250° C., and preferably higher than 150° C. However, no heating condition is particularly limited to this condition. The vacuum container is heated in a condition suitably selected by various conditions such as a size and a shape of the vacuum container, the construction of the electron emitting device, etc. It is necessary to reduce a pressure within the vacuum container as much as possible. This pressure is preferably equal to or lower than $1\times10^{-5}$ Pa and is particularly preferably equal to or lower than $1.3\times10^{-6}$ Pa.

With respect to the atmosphere at an operating time after the stabilizing process is performed, it is preferable to maintain the atmosphere after the above stabilizing process is terminated. However, the present invention is not limited to this atmosphere. If the organic substance is sufficiently removed, sufficient stable characteristics can be maintained even when a vacuum degree itself is slightly reduced.

The deposition of the new carbon and carbon compound can be restrained by adopting such a vacuum atmosphere and $H_2O$, $O_2$, etc. adsorbed to the vacuum container and the substrate, etc. can be also removed therefrom so that the element current If and the emission current Ie are stabilized.

Figure 3:
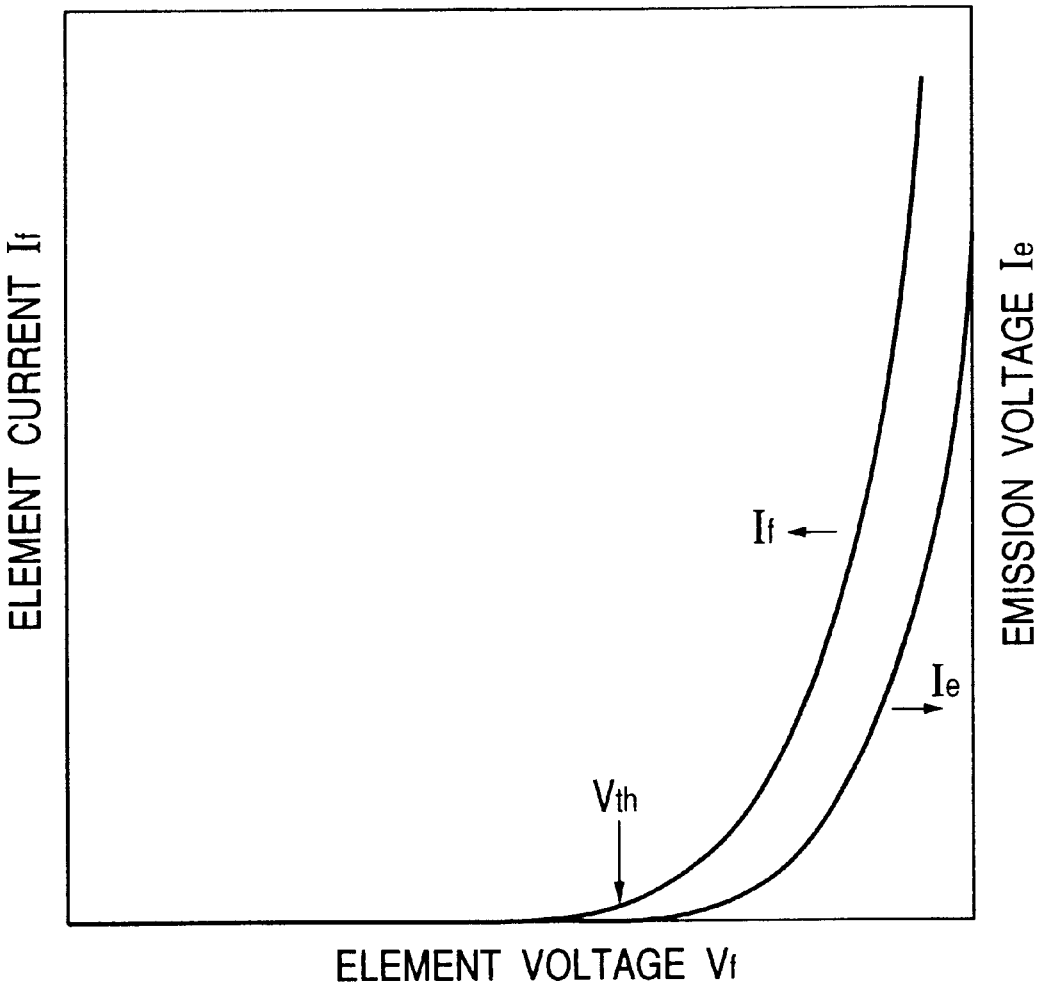
FIG. 3 is a graph for explaining I–V characteristics of the surface conduction electron emitting device.

The relation of the voltage Vf applied to the element electrodes 42, 43 of the electron emitting device, the device current If and the emission current Ie in the surface conduction electron emitting device obtained in this way is provided as typically shown in FIG. 3. In FIG. 3, this relation is shown in an arbitrary unit since the emission current Ie is greatly smaller than the device current If. Both ordinate and abscissa axes in FIG. 3 are shown by a linear scale.

As shown in FIG. 3, when the element voltage Vf equal to or higher than a certain voltage (called a threshold voltage Vth in FIG. 3) is applied to this electron emitting device, the emission current Ie is suddenly increased. In contrast to this, when the device voltage Vf equal to or lower than the threshold voltage Vth is applied to the electron emitting device, no emission current Ie is almost detected. Namely, the electron emitting device is a nonlinear element having the clear threshold voltage Vth with respect to the emission current Ie. If this device is utilized, matrix wiring is performed in the electron emitting device two-dimensionally arranged and electrons are selectively emitted from a desirable element by simple matrix driving and are irradiated to an image forming member so that an image can be formed.

Next, an example of the construction of a phosphor film constituting the image display member and constructed by the phosphor 4 and the metal back 5 will be explained.

Figure 4A:
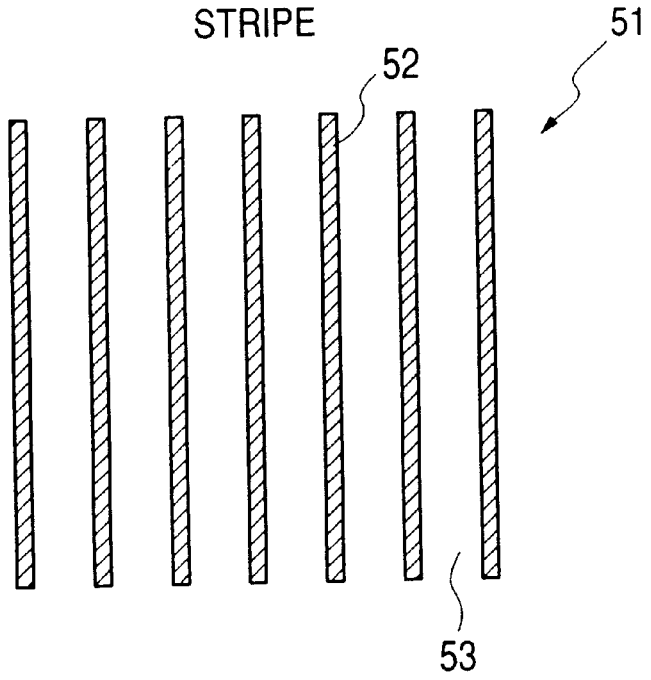
FIGS. 4A and 4B are views for explaining the construction of a phosphor face.
Figure 4B:
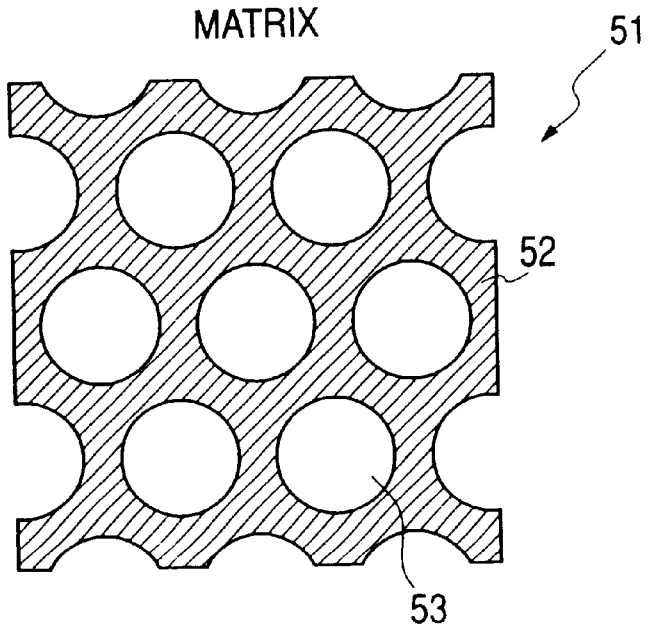

FIGS. 4A and 4B are typical views showing the phosphor film. The phosphor film 51 can be constructed by only the phosphor 4 in the case of a monochrome. In the case of a color phosphor film, the phosphor film can be constructed by a phosphor 53 and a black conductive material 52 called a black stripe or a black matrix, etc. by arranging the phosphor 4. The black stripe and the black matrix are formed since no mixing color, etc. are conspicuous by setting coloring-separating portions between respective phosphors 53 of required three primary colors to be black in the case of a color display and a reduction in contrast due to reflection of external light in the phosphor film 51 is restrained. A material of the black stripe can be constructed by using a material having graphite normally used as a main component, and a conductive material for reducing passage and reflection of light.

A sedimentation method, a printing method, etc. can be adopted irrespective of a monochrome and a color in a method for coating the face plate 2 with the phosphor. A metal back 54 is normally arranged on an inner surface side of the phosphor film 51. The metal back 5 is arranged since luminance is improved by reflecting light on an inner surface side among light emitted from the phosphor 4 onto a side of the face plate 2 on a mirror face, and the metal back acts as an electrode for applying an electron beam accelerating voltage, and the phosphor is protected from damage due to a collision of negative ions generated within the vacuum container, etc. After a phosphor film is manufactured, smoothing processing (normally called "filming" of a surface of the phosphor film on its inner surface side is performed and Al (aluminum) is then deposited by using vacuum evaporation, etc. so that the metal back 5 is manufactured.

A transparent electrode may be also arranged in the face plate 2 on an outer face side of the phosphor film 51 to further improve a conductive property of the phosphor film 51.

In the case of a color, it is necessary that each color phosphor corresponds to the electron emitting device. Accordingly, a sufficient position alignment is indispensable and position aligning processing is performed. Thus, a planar type image display unit is manufactured.

As explained above, a portion directly coming in contact with the rear plate 1 and a portion joined to the rear plate 1 through the frit glass 8 are formed in the voltage introducing terminal 10 so that the distance between the voltage introducing terminal 10 and the rear plate 1 can be prescribed. Thus, sufficient connection can be obtained even when melting irregularities of the frit glass 8 are caused. Accordingly, it is possible to improve reliability of the connection of a high voltage electrode formed in the face plate 2 and the central electrode 9 formed in the voltage introducing terminal 10.

Embodiments

Next, the present invention will be further explained on the basis of embodiments.

Embodiment 1

Plural surface conduction type electron emitting devices are formed on the rear plate also used as a substrate, and an electron source is formed by wiring these surface conduction type electron emitting devices in a matrix shape. A planar type image display unit is made by using this electron source. A making procedure will next be explained with reference to FIGS. 5A to 5E and FIG. 6.

(Process-a)

A hole 16 for vacuum exhaust (FIG. 6) and a voltage introducing terminal passing hole 15 (FIG. 6) are formed in a blue plate glass and this blue plate glass is sufficiently washed. Thereafter, an $SiO_2$ layer of 0.5 $\mu$m in thickness is formed on a surface of the blue plate glass by sputtering and is set to a rear plate 1. The above voltage introducing terminal passing hole 15 of 10 mm in diameter is arranged in a position opposed to the phosphor pull-out electrode 6 (FIG. 6) of the face plate 2 described later.

Figure 5A:
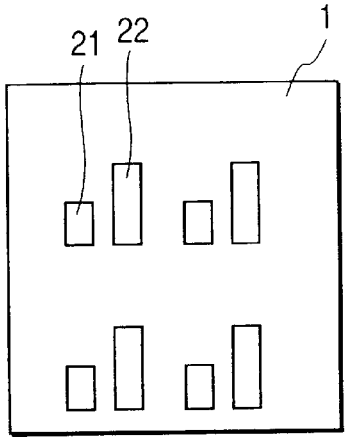
FIGS. 5A, 5B, 5C, 5D and 5E are views for explaining a manufacturing process of a rear plate (an electron source substrate)

Next, device electrodes 21 and 22 of each surface conduction type electron emitting device are formed on the above rear plate 1 by using a sputtering film forming method and a photolithography method. Materials of the device electrodes 21 and 22 are constructed by laminating Ti of 5 nm in thickness and Ni of 100 nm in thickness. The distance between the device electrodes is set to 2 $\mu$m (FIG. 5A).

(Process-b)

Figure 5B:
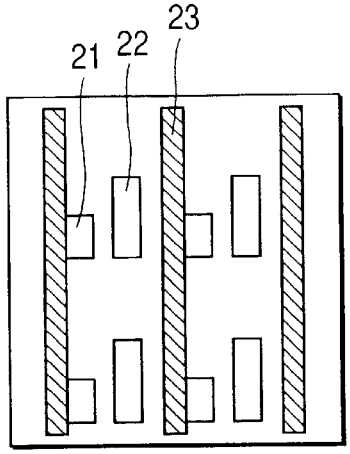

Subsequently, an Ag paste is printed in a predetermined shape and is burned so that a Y-directional wiring 23 is formed. This wiring 23 is extended up to the exterior of an electron source forming area and becomes a wiring 3-2 for operating the electron source in FIGS. 1A and 1B. The wiring 23 has 100 $\mu$m in width and about 10 $\mu$m in thickness (FIG. 5B).

(Process-c)

Figure 5C:
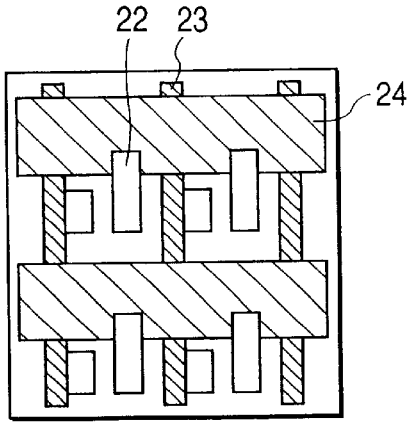

Next, an insulating layer 24 is similarly formed by the printing method by using paste having PbO as a main component and mixed with a glass binder. This insulating layer 24 insulates the above Y-directional wiring 23 and an X-directional wiring described later from each other, and is formed such that this insulating layer 24 has about 20 $\mu$m in thickness. A notch is formed in a portion 6 f the element electrode 22 so that the X-directional wiring and the device electrode 22 are connected to each other (FIG. 5C).

(Process-d)

Figure 5D:
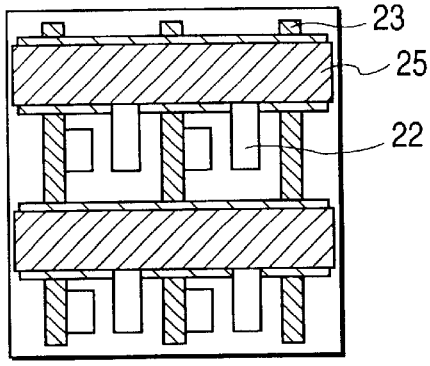

Subsequently, the X-directional wiring 25 is formed on the above insulating layer 24 (FIG. 5D). A forming method of the X-directional wiring 25 is similar to that of the Y-directional wiring 23 and the X-directional wiring 25 has 300 $\mu$m in width and about 10 $\mu$m in thickness.

Subsequently, a conductive film 26 constructed by PdO particulates is formed. In a forming method of the conductive film 26, a Cr film is formed on the substrate forming the wirings therein by the sputtering method, and an opening portion corresponding to a shape of the conductive film 26 is formed in the Cr film by the photolithography method.

Figure 5E:
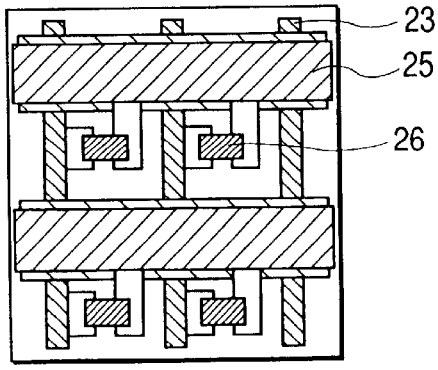

Subsequently, the Cr film is coated with an organic Pd solution (ccp-4230 manufactured by OKUNO SEIYAKU Co., Ltd.) and is burned for 12 minutes in the atmosphere at 300° C. so that a PdO particulate film is formed. Thereafter, the above Cr film is removed by wet etching so that the conductive film 26 having a predetermined shape is obtained by lift-off (FIG. 5E). Thus, plural conductive films 26 matrix-wired by the plural X-directional wirings 25 and plural Y-directional wirings 23 are manufactured on the rear plate 1.

Figure 6:
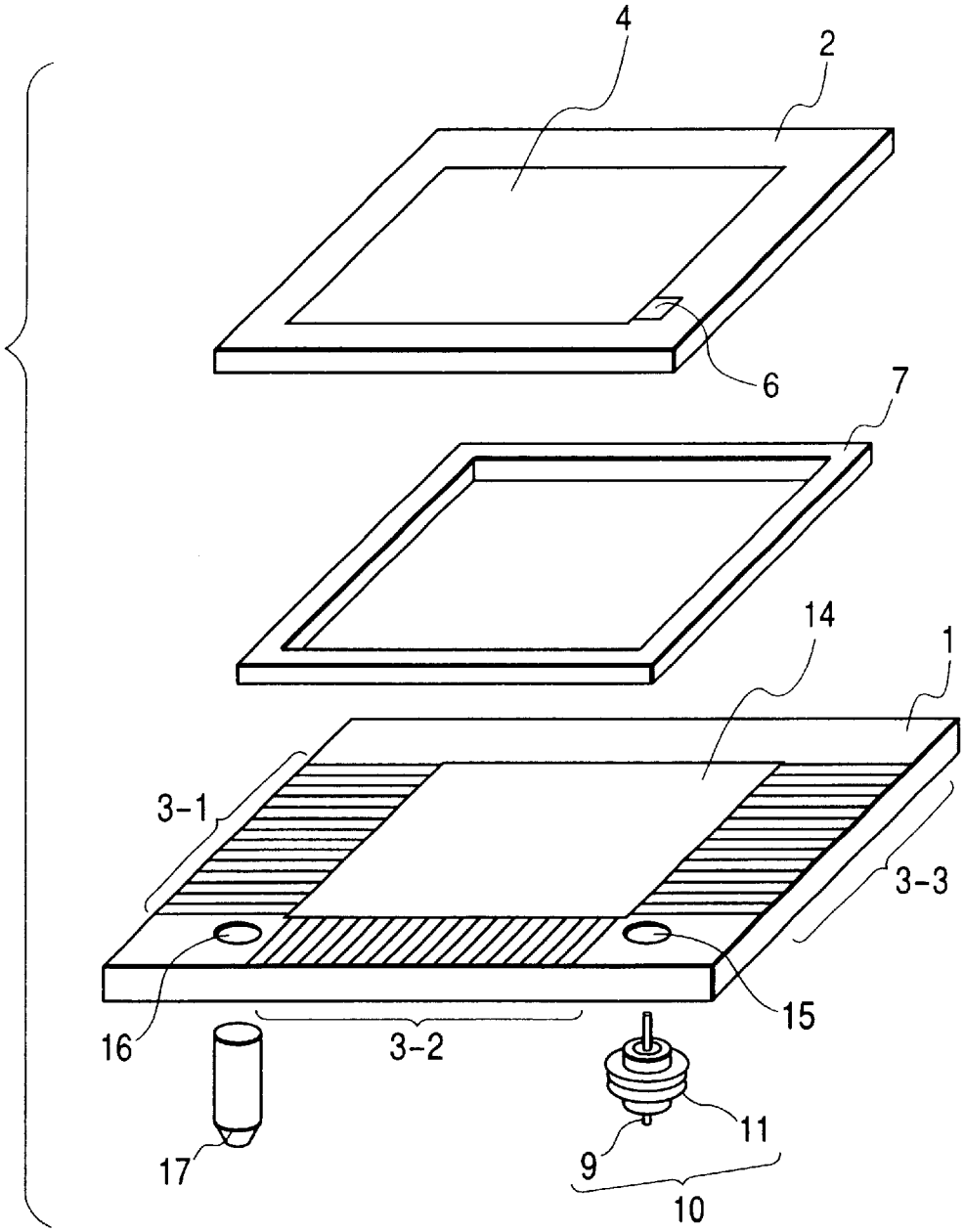
FIG. 6 is a perspective view showing a main member of the planar type image display unit in a first embodiment of the present invention.

(Process-e; hereinafter see FIG. 6)

Subsequently, a supporting frame 7 and the above rear plate 1 are sealed and attached by using frit glass. The supporting frame 7 has 3 mm in height (thickness). Thus, the distance between the rear plate 1 and the face plate 2, i.e., the distance between the electron source and the phosphor 4 is held at about 3 mm in the planar type image display unit in this embodiment.

(Process-f)

Next, manufacture of the face plate 2 including the substrate will be described. A blue plate glass is used as the substrate 2.

A phosphor pull-out electrode 6 is formed by printing Ag in a pattern (having an overlapping portion) for conducting this electrode to a metal back described below. Further, a black stripe of a phosphor film and a phosphor 4 of a stripe shape are subsequently formed, and filming processing is performed. Thereafter, an Al (aluminum) film of about 0.1 $\mu$m in thickness is deposited on the phosphor 4 by a vacuum evaporation method and is set to the metal back.

(Process-g)

The supporting frame 7 joined to the above rear plate is joined to the above face plate 2 by using frit glass so that a container constructed by the rear plate 1, the supporting frame 7 and the face plate 2 is formed. The frit glass is used as an adhesive and a main component of the frit glass is PbO. A coefficient of thermal expansion of the frit glass can be adjusted such that this coefficient is approximately equal to coefficients of thermal expansion of the rear plate and the face plate, etc.

In this case, the voltage introducing terminal 10 and an exhaust pipe 17 for vacuum-exhausting the air within the container are simultaneously aligned with respective corresponding holes 15, 16 on the rear plate 1 in position and are joined to these holes with the frit glass.

The voltage introducing terminal 10 is set to have a structure in which a bar of an Fe—Ni alloy covering Au (gold) is set to the central electrode 9 and is inserted into a ceramic insulator 11 having steatite porcelain as a main component.

Figure 7:
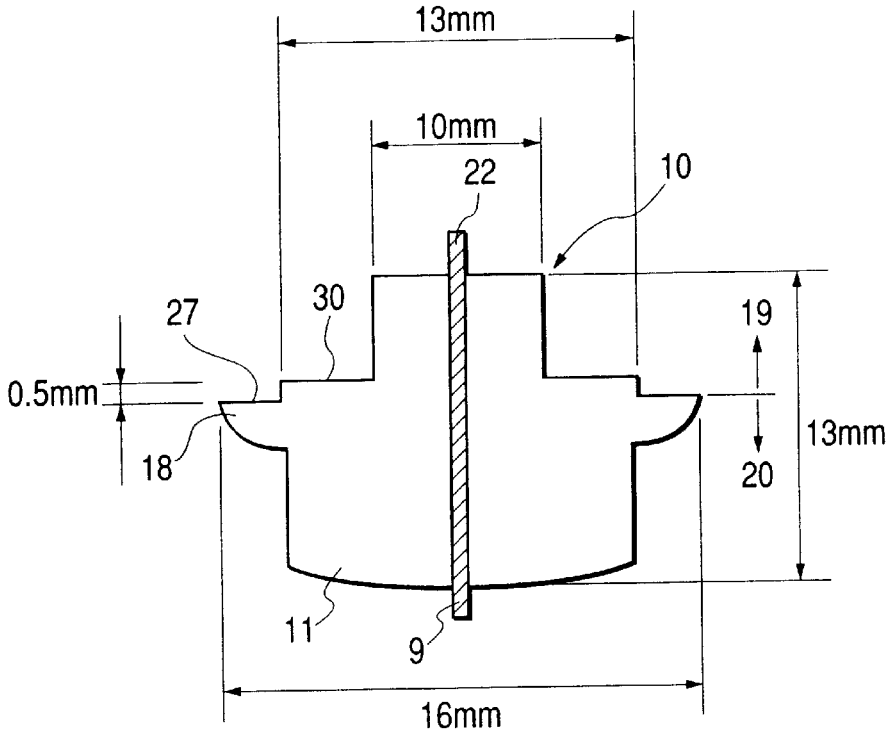
FIG. 7 is an enlarged sectional view of a voltage introducing terminal in the first embodiment of the present invention.

Here, an entire shape of the voltage introducing terminal 10 is shown in FIG. 7.

As shown by a cross-sectional view of the voltage introducing terminal 10 of FIG. 7, the insulator 11 made of ceramic is formed such that a projecting portion 18 having 16 mm in outer diameter and 2 mm in height (thickness) is integrated with a portion approximately formed in a columnar shape and having 10 mm in outer diameter and 13 mm in height.

Further, a bar having 0.8 mm in diameter and made of an Fe—Ni alloy as the central electrode 9 of the voltage introducing terminal 10 is inserted into the insulator 11. A height prescribing portion 30 having 13 mm in outer diameter and 0.5 mm in height (thickness) is formed in a portion on an outer surrounding side (19 in FIG. 7) of the insulator 11 from a projecting portion planar 27.

The projecting portion 18 has the planar 27 and is adhered to a rear face of the rear plate substrate 1 by the frit glass in this planar portion 27.

A portion on an outer surrounding side (19 in FIG. 7) from the planar 27 of the projecting portion 18 of the insulator 11 is fitted into a through hole 15 formed in the rear plate 1. A tip 22 of the central electrode 9 is pressed against the phosphor pull-out electrode 6 on an inner surface of the face plate. Thus, a joining operation is electrically performed elastically or by a connecting method using melting of a metal, etc.

The voltage introducing terminal 10 in this embodiment is independent as a member constituting the vacuum container. Accordingly, the above voltage introducing element 10 can be adhered to the rear plate 1 in a process after the adhesion of other portions (the face plate 2, the rear plate 1 and the supporting frame 7) forming the outer surrounding portion is terminated. Therefore, a technique of the electric joining to the phosphor pull-out electrode 6 can be suitably selected.

The distance between the voltage introducing terminal 10 and the rear plate substrate 1 is dispersed by melting irregularities of the frit glass in the conventional structure. However, the dispersion due to the melting irregularities of the frit glass can be removed by the structure of the voltage introducing terminal 10 forming the above height prescribing portion 30 therein.

Thus, the voltage introducing terminal 10 and the rear plate substrate 1 are reliably connected to each other in accordance with the voltage introducing terminal 10 in this embodiment of the present invention.

When the rear plate 1 and the face plate 2 are joined to each other, positions of each electron emitting device of the electron source and the phosphor of the face plate 2 are carefully aligned with each other such that these positions accurately correspond to each other.

(Process-h)

The above container is connected to the vacuum exhausting device through the exhaust pipe 17 and the air within the container is exhausted. When the pressure within the container is equal to or lower than $10^{-4}$ Pa, the following forming processing is performed.

Figure 8:
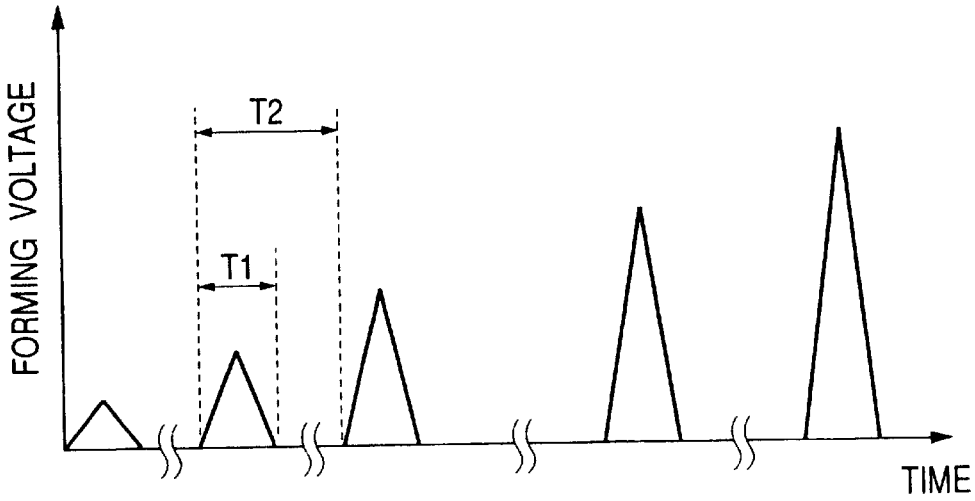
FIG. 8 is a graph showing an example of a forming voltage of the surface conduction electron emitting device.

In the above forming processing, the Y-directional wirings 23 are commonly connected and a pulse voltage gradually increased in crest value as typically shown in FIG. 8 is applied to each X-directional wiring 25 every line in an X-direction, and a current flows through plural conductive films 26. A pulse spacing T1 is set to 10 sec and a pulse width T2 is set to 1 msec. A rectangular wave pulse of 0.1 V in crest value is inserted between pulses for forming and a current value is measured, and a resistance value of the electron emitting device is simultaneously measured. When the resistance value per one element exceeds 1 M ohms, the forming processing on this line is terminated and it proceeds to the forming processing on the next line. This processing is repeated so that the forming processing with respect to all lines is completed. A crack is formed in each of the conductive films 26 by the above forming processing.

(Process-i)

Activating processing is next performed. While the above container is held at 200° C. before this processing, the air within this container is exhausted by an ion pump and the pressure is reduced to a value equal to or smaller than $10^{-5}$ Pa. Subsequently, acetone is introduced into the container. An introducing amount of acetone is adjusted such that the pressure is equal to $1.3\times10^{-2}$ Pa. Subsequently, similar to the above forming processing, a pulse voltage is applied to the X-directional wiring. A pulse waveform in this case is set to a rectangular wave pulse having a crest value of 16 V and have 100 μsec in pulse width. The X-directional wiring applying a pulse thereto is switched to an adjacent line at an interval of 125 μsec every one pulse, and the pulse is sequentially repeatedly applied to each wiring in a line direction. As a result, the pulse is applied to the wiring on each line at an interval of 10 msec. As a result of this activating processing, a film having carbon as a main component is formed in the vicinity of an electron emitting portion of the electron emitting device in each of the above conductive films 26 so that an element current If is increased.

(Process-j)

Subsequently, the air within the container is again exhausted. The exhaust is continued for 10 hours by using the ion pump while the container is held at 200° C. This process is set to remove organic substance molecules left within the outer surrounding portion and stabilize electron emitting characteristics by preventing the above film having carbon as a main component from being further deposited.

(Process-k)

After the temperature of the container is returned to a room temperature, a pulse voltage is applied to the X-directional wiring 25 in a method similar to that in the process-h. Further, light is emitted from the phosphor by applying a voltage of 4 kV to the phosphor 4 through the above voltage introducing terminal 10.

Thereafter, the applied voltage is gradually increased to 10 kV.

It is visually confirmed that there is not a light unemitting portion or a very dark portion. The application of the voltage to the X-directional wiring 25 and the phosphor 4 is stopped and the exhaust pipe 17 is heated, melted, attached and sealed. Subsequently, processing of a getter (not shown) is performed by high-frequency heating so that a planar type image display unit is completed.

Figure 11:
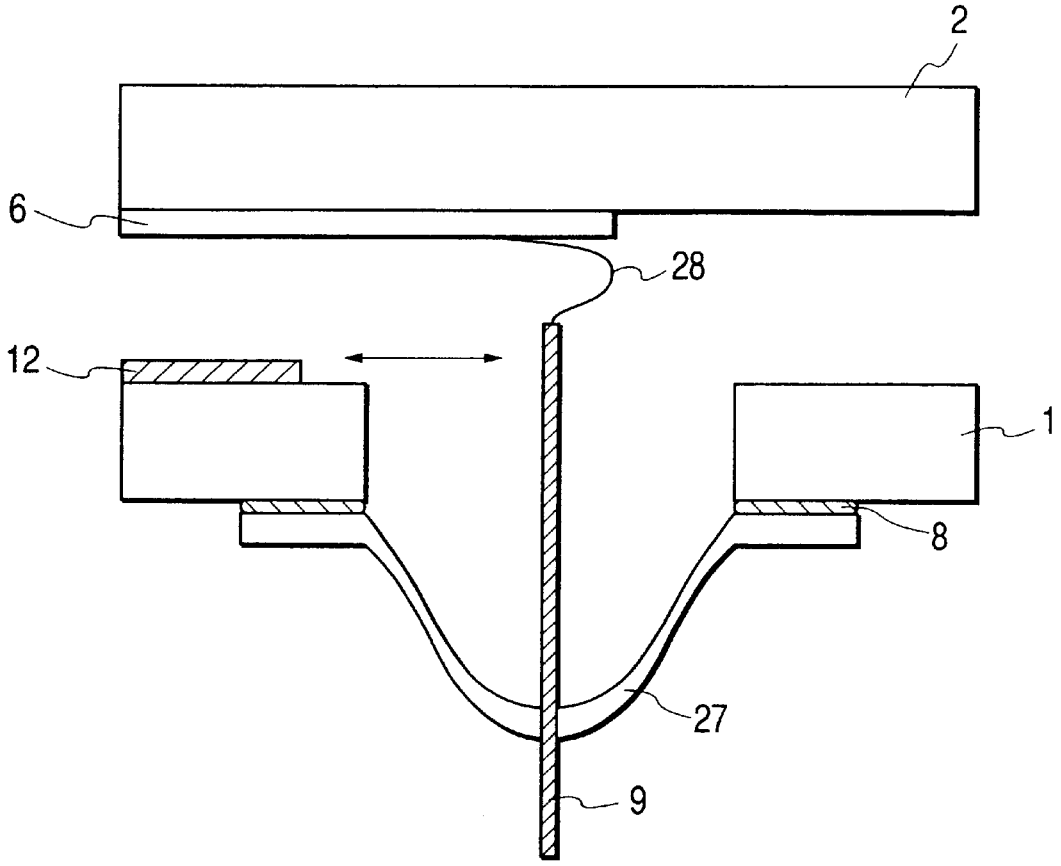
FIG. 11 is a cross-sectional view showing a main portion of a voltage introducing structure from a rear plate of a conventional planar type image display unit.

In the planar type image display unit manufactured as mentioned above, a connection situation of the voltage introducing terminal 10 and conduction of the voltage introducing terminal 10 with the face plate are measured and compared with a case in which the conventional structure (FIG. 11) is used.

As a result, there is a case in which a vacuum slow leak due to a defect in adhesion is caused or the conduction with the face plate becomes unstable in the conventional structure. However, when the voltage introducing terminal in this embodiment is used, no slow leak due to the defect in adhesion is observed and stable conduction can be obtained. Accordingly, it is confirmed that reliable connection can be obtained in comparison with the conventional case, and high voltage can be stably applied. Further, when an image is actually displayed, the displayed image is excellent in luminance and chromaticity.

In the above embodiment, the surface conduction electron emitting device is used as the electron emitting element constituting the electron source, but no construction of the present invention is naturally limited to this case. The present invention can be similarly applied to a case in which electron sources using an electric field emitting (FE type) electron emitting device, a semiconductor electron emitting device and other various kinds of electron emitting devices are used.

In this embodiment, the rear plate of the image forming apparatus is also used as the substrate of the electron source. However, the rear plate and the substrate may be separated from each other and the substrate may be also fixed to the rear plate after the electron source is made.

Further, various kinds of members shown in the embodiment may be suitably changed within the scope of a technical idea in the present invention.

Embodiment 2

Figure 9A:
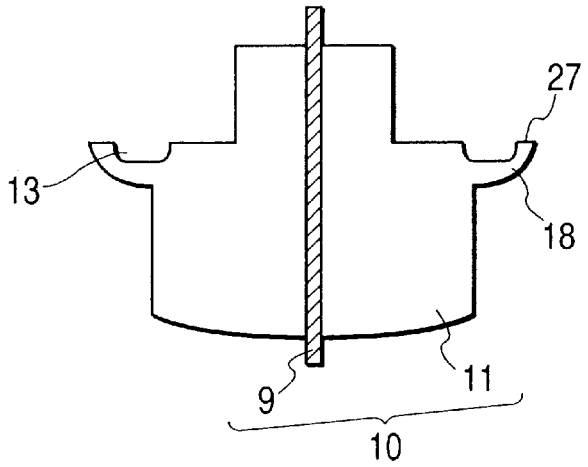
FIGS. 9A and 9B are cross-sectional views showing the structure of a voltage introducing terminal portion of a planar type image display unit in a second embodiment of the present invention.
Figure 9B:
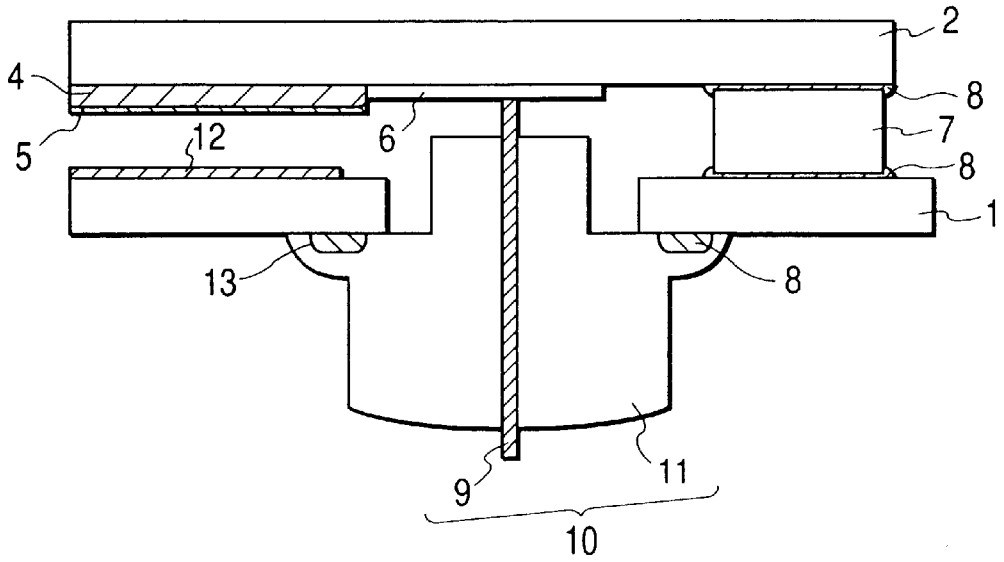

A second embodiment of the voltage introducing terminal of the planar type image display unit in the present invention is shown in FIGS. 9A and 9B.

An entire construction of the planar type image display unit in this embodiment is similar to that in the embodiment 1 and is therefore omitted here. In this embodiment, a cross-sectional view of the voltage introducing terminal is shown in FIG. 9A and a portion corresponding to a section 1B—1B of FIG. 1A is shown in FIG. 9B. In these figures, the same reference numerals as FIG. 7 show the same members and an overlapping explanation thereof is omitted here.

As shown in FIG. 9A, a bar of an Fe—Ni alloy having a diameter ϕ from 0.8 mm to 1 mm as the central electrode 9 of the voltage introducing terminal 10 is inserted into the insulator 11 in this embodiment. A groove 13 of 1.0 mm in depth is formed in a concentric shape in the projecting planar portion 27 of the insulator 11.

As shown in FIG. 9B, frit glass is buried in the groove 13 of the projecting planar portion and is adhered to the rear plate 1. The groove 13 of the projecting planar portion is constructed by forming the groove 13 recessed in the planar 27 of the projecting portion 18 in a circumferential shape and filling this groove 13 with frit glass. Thereafter, the groove 13 is combined with the rear plate 1 and is adhered to this rear plate 1.

In this embodiment, a direct contact portion of the insulator 11 of the voltage introducing terminal 10 and the rear plate substrate 1 is set to a height prescribing portion so that no dispersion in height due to melting irregularities of the frit glass is caused. Accordingly, reliable connection can be obtained and high voltage can be stably applied.

Embodiment 3

Figure 10A:
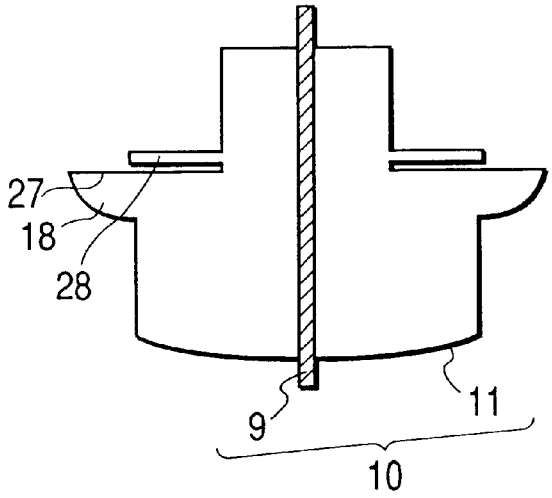
FIGS. 10A and 10B are cross-sectional views showing the structure of a voltage introducing terminal portion of a planar type image display unit in a third embodiment of the present invention.
Figure 10B:
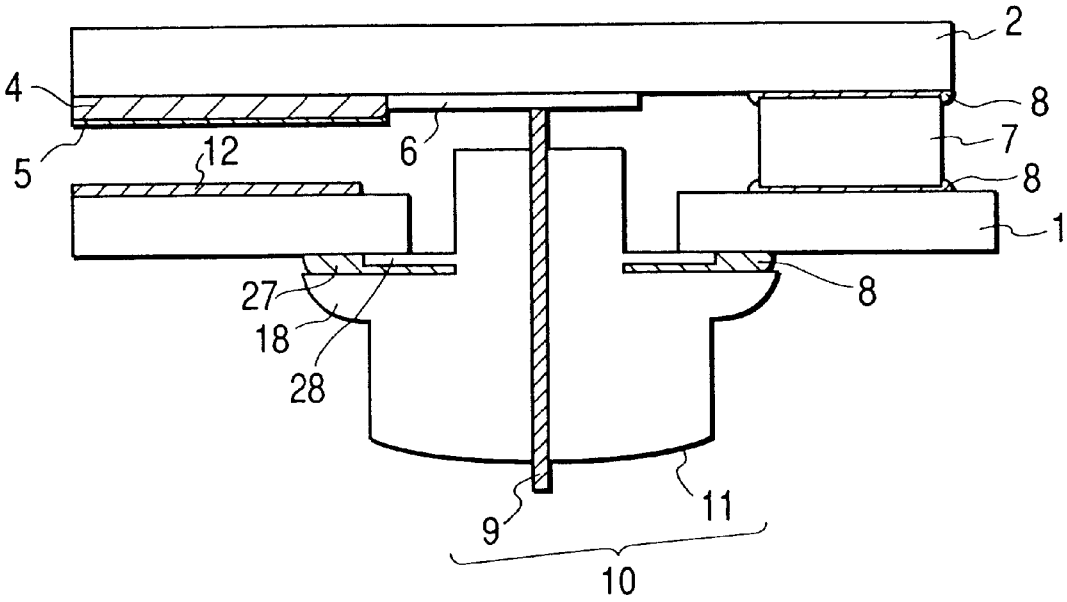

A third embodiment of the voltage introducing terminal of the planar type image display unit in the present invention is shown in FIGS. 10A and 10B.

An entire construction of the planar type image display unit in this embodiment is similar to that in the embodiment 1 and is therefore omitted here. In this embodiment, a cross-sectional view of a high voltage introducing terminal is shown in FIG. 10A and a portion corresponding to the section 1B—1B of FIG. 1A is shown in FIG. 10B. In these figures, the same members as FIGS. 7 and 9 are designated by the same reference numerals and an overlapping explanation thereof is omitted here.

As shown in FIG. 10A, a bar of an Fe—Ni alloy having a diameter of from 0.8 mm to 1 mm as the central electrode 9 of the voltage introducing terminal 10 is inserted into the insulator 11 in this embodiment. A projection 28 is formed in a fin shape in parallel with the planar portion 27 of the projecting portion 18 of the insulator 11.

As shown in FIG. 10B, the projecting planar portion 27 and the projection 28 formed in a fin shape are adhered to the rear plate through frit glass.

In this embodiment, the projection 28 formed in a fin shape is set to a height prescribing portion slightly having an elastic property when the insulator 11 of the voltage introducing terminal 10 and the rear plate substrate 1 are joined to each other. Accordingly, there is no dispersion in height due to melting irregularities of the frit glass, and strength is increased since an adhesive area of the frit glass is large. Therefore, reliable connection can be obtained and high voltage can be stably applied.

Effect of the Invention

As explained above, the present invention can provide an image display unit having a conductive path with good electric conduction to apply a voltage from the exterior of the container to an electric conductor within the container.

The present invention can also provide an image display unit connected in good condition to the electric conductor within the container and having an electric conductor for supplying a voltage from the exterior of the container to the electric conductor within the container.

The present invention can also provide an image display unit having a container sufficiently airtightly sealed and attached.

What is claimed is:

1. An image display unit comprising:

(a) a first substrate having an opening and including an electron source disposed at a surface thereof;

(b) a second substrate provided with an image forming member and a first electric conductor at a surface thereof, and being disposed such that the surface of said second substrate on which said image forming member is in opposition to the surface of said first substrate on which said electron source is disposed;

(c) a frame fitted between said first and second substrates; and (d) a fitting member fitting the opening of the first substrate, said fitting member holding a second electric conductor coming in contact with said first electric conductor through the opening, wherein said fitting member comprises a first portion joined to said first substrate with an adhesive and a second portion directly in contact with a surface of said first substrate opposite to the surface on which said electron source is disposed.

2. An image display unit comprising:

a rear plate having an opening and an electron source disposed on a surface thereof;

a face plate disposed in opposition to said rear plate, said face plate including a phosphor emitting light responsive to irradiation with an electron beam emitted from said electron source, and an anode electrode for applying a voltage to said phosphor;

a supporting frame sandwiched between said rear plate and said face plate; and an insulating member provided with an electrode extending through the opening in said rear plate and introducing a voltage into said anode electrode disposed on an inner surface of said face plate, wherein said insulating member fits the opening and comprises a first portion joined to said rear plate with an adhesive and a second portion directly contacting a rear surface of said rear plate opposite to the surface on which said electron source is disposed.

3. An image display unit according to claim 2, wherein said insulating member fitting the hole has a groove in which adhesive is arranged.

4. An image display unit according to any one of claims 1 to 3, wherein said electron source has plural cold cathode electron emitting devices.

5. An image display unit comprising:

(a) a first substrate having an opening and including an electron source disposed at a surface thereof;

(b) a second substrate provided with an image forming member and a first electric conductor at a surface thereof, and being disposed such that the surface of said second substrate on which said image forming member is in opposition to the surface of said first substrate on which said electron source is disposed;

(c) a frame fitted between said first and second substrates; and (d) a fitting member fitting the opening of the first substrate, said fitting member holding a second electric conductor coming in contact with said first electric conductor through the opening, wherein said fitting member comprises a first portion joined to said first substrate with an adhesive and a second portion in contact with a surface of said first substrate opposite to the surface on which said electron source is disposed without an adhesive.

* * * * *

UNITED STATES PATENT AND TRADEMARK OFFICE

CERTIFICATE OF CORRECTION

PATENT NO. : 6,603,255 B2
DATED : August 5, 2003
INVENTOR(S) : Nobuyuki Takahashi It is certified that error appears in the above-identified patent and that said Letters Patent is hereby corrected as shown below:

Column 2,
Line 61, “land” should read -- and --.

Signed and Sealed this

Sixteenth Day of March, 2004

JON W. DUDAS
*Acting Director of the United States Patent and Trademark Office*